US005845867A

United States Patent [19]

Hould et al.

[11] Patent Number: 5,845,867

[45] Date of Patent: Dec. 8, 1998

[54] CONTINUOUS WINDER

[75] Inventors: Daniel F. Hould, Oswego; Thomas J. Walsh, III, Auburn; Robert F. Moeller, Baldwinsville, all of N.Y.

[73] Assignee: The Black Clawson Company, New York, N.Y.

[21] Appl. No.: 949,090

[22] Filed: Oct. 10, 1997

[51] Int. Cl.[6] ..... B65H 19/26

[52] U.S. Cl. ..... 242/527; 242/527.2; 242/533.4

[58] Field of Search ..... 242/527, 527.2, 242/527.6, 532.3, 533.4, 533.5, 533.6

[56] References Cited

U.S. PATENT DOCUMENTS

| | | | |
|---|---|---|---|
| 2,256,082 | 9/1941 | Feurt | 242/527.5 |
| 3,592,403 | 7/1971 | Schmitt et al. | 242/527.5 |
| 3,697,010 | 10/1972 | Nystrand . | |
| 3,784,122 | 1/1974 | Kataoka | 242/527.6 |
| 3,871,595 | 3/1975 | Smolderen | 242/533.4 |
| 4,058,267 | 11/1977 | Schuttler | 242/527.4 |
| 4,153,215 | 5/1979 | Schulze | 242/527.3 |
| 4,171,780 | 10/1979 | Bugnone | 242/532.3 |
| 4,458,852 | 7/1984 | Calvert et al. . | |
| 4,529,141 | 7/1985 | McClenathan et al. | 242/527.1 |
| 4,541,583 | 9/1985 | Forman et al. | 242/532.3 |
| 4,630,783 | 12/1986 | Mulfarth | 242/527.3 |
| 4,678,133 | 7/1987 | Suzuki | 242/533.4 |
| 4,715,552 | 12/1987 | Matsumoto | 242/527.5 |
| 4,728,050 | 3/1988 | Luttge et al. | 242/527.3 |
| 4,770,358 | 9/1988 | Suzuki et al. . | |
| 4,802,632 | 2/1989 | Fukuda et al. | 242/527 |
| 4,993,652 | 2/1991 | Moeller | 242/527.3 |
| 5,086,986 | 2/1992 | Twente | 242/527.2 |
| 5,226,612 | 7/1993 | Mülfarth . | |
| 5,417,382 | 5/1995 | Petitjean et al. | 242/527 |

OTHER PUBLICATIONS

The Black Clawson Company Quotation No. 97–E–0218, entitled, 160 Inch –Finished Width High Output Stretch Wrap Line, dated Jun. 24, 1996 (partial copy).

The Black Clawson Company Drawing No. S–7–0218, dated Jul. 2, 1996, entitled 160" Finished Web Cast Stretch Film Line.

*Primary Examiner*—John P. Darling
*Attorney, Agent, or Firm*—Biebel & French

[57] ABSTRACT

A turret winder for winding web material on spindle-supported cores has a turret which is moveable into three indexing positions, one of which is a web transfer, cutting and winding station, and another of which is a winding completion station. Frames adjacent to the turret support carriages which support a secondary lay-on roll. The carriages include a primary carriage which is moveable vertically with respect to the turret and a lay-on roll carriage which is moveable horizontally with respect to the primary carriage. The lay-on roll carriage has an arm which is engaged by the turret during movement of the spindle between the above two positions so that arcuate movement of the spindle is translated to movement of the lay-on roll carriage in such a manner that the lay-on roll accurately follows the movement as the building roll moves to the winding completion station.

8 Claims, 7 Drawing Sheets

CONTINUOUS WINDER

BACKGROUND OF THE INVENTION

This application relates to continuous turret-type web winders and more particularly to such a winder that includes a primary and auxiliary lay-on rolls that co-act with a building roll to exclude air from being carried by a winding web between the web and the convolutions of the roll.

In turret-type winders, a lay-on roll is used over which the web passes before the web is nipped to the surface of the building roll. By partially wrapping the onconiing web over the lay-on roll, a nip with the building roll can be formed in which air between the web and the roll is excluded while the building roll is at a winding station. However, prior to completion of the roll, it must be indexed or moved to a winding completion station so that a newly placed core can be brought into the winding station, and so that the web can cut and be transferred to the core when the winding of the building roll is completed, thus starting a new roll on a new core. The now completed roll is indexed or moved to a take-off station where the roll is removed, and a new core is inserted on the spindles.

During indexing movement from an initial winding station, the auxiliary lay-on roll takes up the task of excluding air and then follows the roll to the winding completion station and continues to function as a lay-on roll until the roll is fully built. The auxiliary lay-on roll picks up the web and nips it to the building roll during the transfer, and maintains the relationship as the building roll moves to the finishing station. While auxiliary lay-on rolls have been mounted on the turret itself, this causes unnecessary complications due to the necessity of operating the lay-on rolls on a moving or rotating member, increases the weight of the turret, and requires that such auxiliary lay-on roll be dedicated to a given position on the turret. When the turret includes three or more winding arbors or spindles, such an arrangement becomes complicated and costly.

A need therefore exists for a more simplified and positive arrangement by which an auxiliary lay-on roll may be related to a building roll and caused to follow accurately the movement of the building roll from an initial web building station to a winding completion station.

SUMMARY OF THE INVENTION

This invention is therefore directed to an improved turret winder for winding paper, plastic film, or other web material on spindle-supported cores, in which a turret is mounted for rotation in a step-like manner to bring the spindles and the cores thereon successively from a web cutting and primary building station, to a winding completion station, and then to a roll take off and new core loading station. The opposite ends of an auxiliary lay-on roll are mounted between primary support carriages and carried on end frames that are independent of the turret. The auxiliary lay-on roll is positioned along lateral sides of the turret in the general vicinity of the primary building station. The primary support carriages are mounted on the end frames for limited vertical movement. Each support secondary lay-on roll carriages that are moveable generally horizontally on the respective primary carriages between a retracted position and an advanced or operation position.

The lay-on roll carriages have a rigid member such as an arm that, upon movement into the operative position are aligned so that it engages a hub or bearing located on the axis of a roll spindle. As a result, that movement of the spindle between the first building station and the winding completion station causes the primary carriage to be moved, concurrently, on its generally vertical axis by reason of the coaction between the turret and the carriage arm. The auxiliary lay-on roll is mounted or positioned in a fixed relationship to the arm such that while the arm is in contact with the spindle hub, the auxiliary lay-on roll nips the building roll substantially at the region of convergence of the running web with the building roll. The lay-on function is continued by the auxiliary lay-on roll throughout the remainder of the transfer into the roll completion station.

Since the rotational movement of the turret is translated to vertical movement of the primary carriage, a geometric relation between the auxiliary lay-on roll and the building roll is maintained during the indexing movement and thereafter, with the secondary carriage retracting laterally as necessary on the primary carriage to accommodate the arcuate movement of the roll during indexing and the increasing size of the building roll after indexing. In this manner, a scrapless roll is formed all the way to the cut end of the web.

In the apparatus of this invention, the position of the auxiliary lay-on roll is directly correlated with the position of the axis of the building roll spindle during the movement of the turret from the time of engagement with the secondary carriage arm to and throughout the final building of the roll. A wrap angle of the web about the auxiliary lay-on roll can thus be maintained while the building of the roll is completed.

The apparatus of the invention further includes a combined knife and electrostatic charge bar carriage. A rotary cut-off knife or other web severing arrangement is mounted on this carriage along with an electrostatic charge bar. The carriage is moveable between a retracted position in which the web cutting apparatus and the charge bar are remotely positioned with respect to the running web. However, when a web cut and transfer is desired, the carriage is moved along rails mounted on the side frames and into an operative position with respect to the web leading to an indexed building roll and a fresh core on a spindle at a winding initiation station. The web severing apparatus and charge bar, in the advanced or operative position of the carriage presents a charge to the web and to the core accompanied by a severing of the web to permit an immediate wrapping of the web about the core by the primary lay-on roll and thereafter, the knife and charge bar carriage may be retracted.

It is accordingly an important object of the invention to provide a scrapless turret-type winder in which an auxiliary lay-on roll is mounted on a moveable carriage, and the position of the lay-on roll is directly related to the position of the axis of the spindle of the building roll.

A further object of the invention is the provision of a turret winder for winding paper or plastic film material on spindle supported cores, in which a turret is mounted for rotation about a horizontal axis and in which an auxiliary lay-on roll is mounted on a secondary carriage which, is in turn, mounted on a primary carriage for orthogonal movement with respect to the movement of the primary carriage, and in which the carriages are temporarily coupled to a spindle of a building roll as the roll is carried on the turret between a winding position and a roll completion position, to provide for smooth transfer from a primary lay-on roll to the auxiliary lay-on roll.

A more particular object of the invention is the provision of a turret winder, as outlined above, in which a lay-on roll carriage has an arm which may be positioned to come into engagement with a bearing on the hub of a spindle moving between a winding station and a winding completion station, so that the lay-on roll carriage is caused to be moved in a geometric relation to the turret spindle as the turret spindle moves between such stations.

Other objects and advantages of the invention will be apparent from the following description, the accompanying drawings and the appended claims.

DESCRIPTION OF PREFERRED EMBODIMENT

Figure 1:
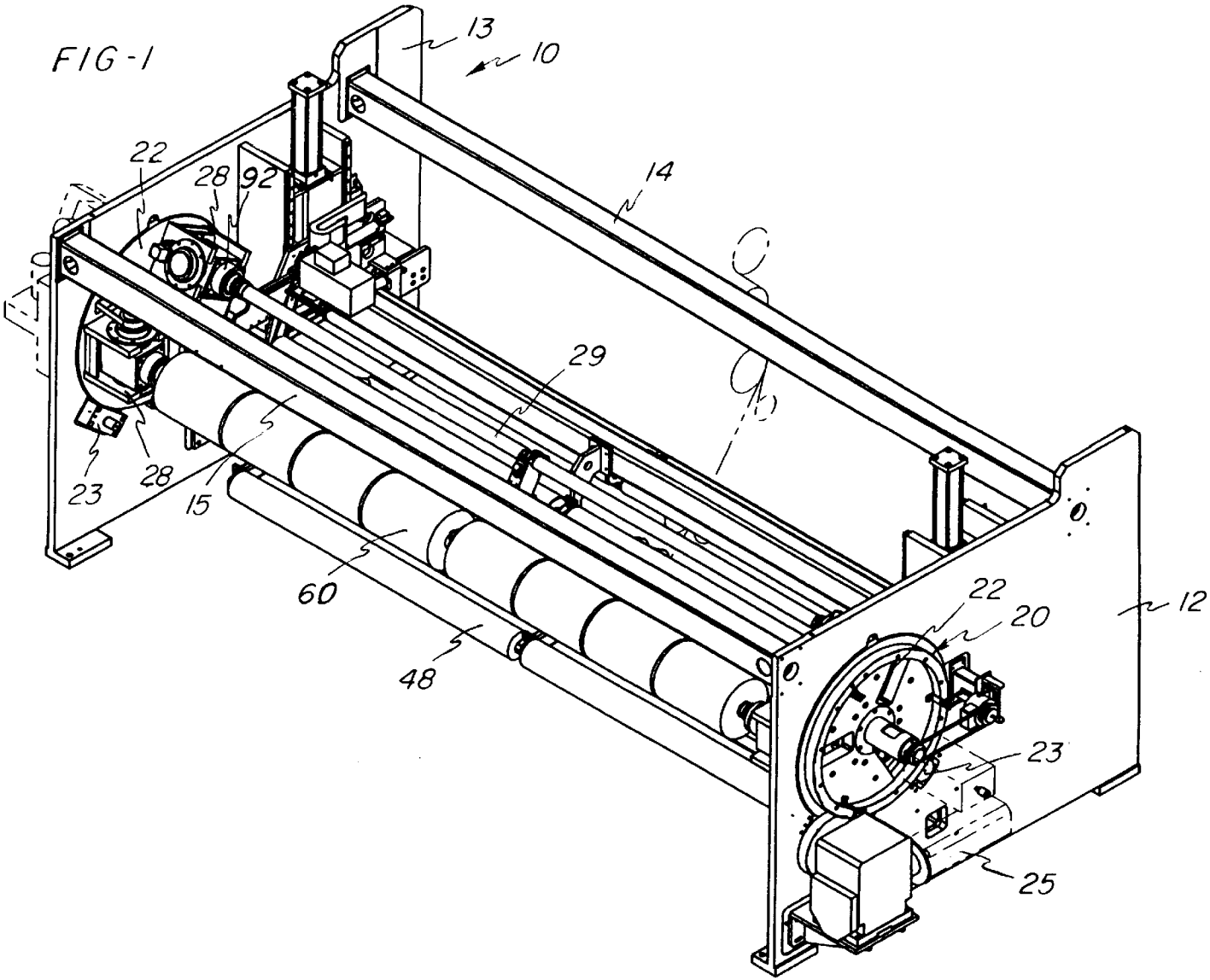
FIG. 1 is a perspective view of a turret-type winder for winding film or paper on a core in accordance with this invention.
Figure 2:
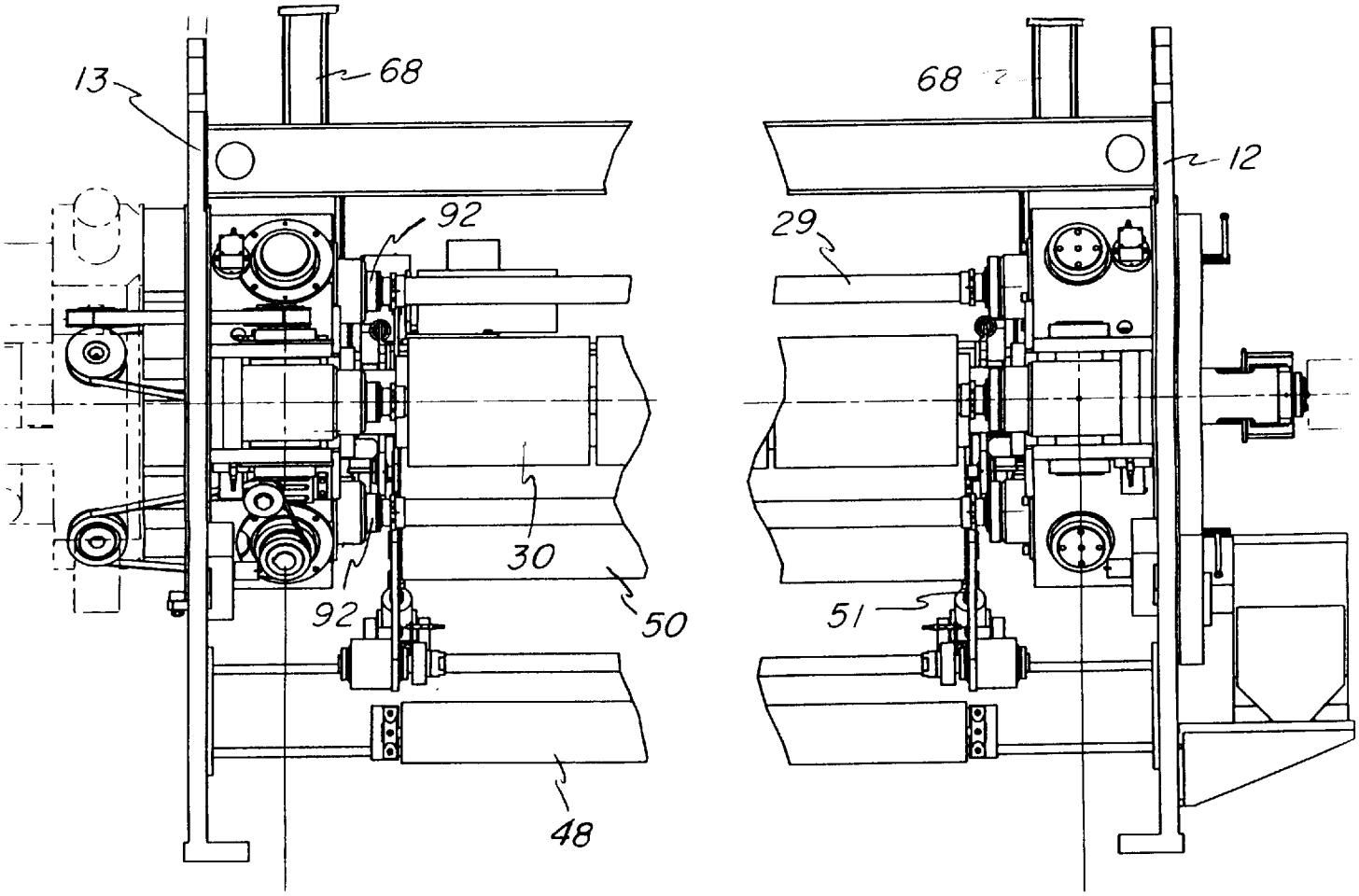
FIG. 2 is a front elevational view, partially broken away, of the winder of FIG. 1.

Referring to the figures of the drawing, which represent a preferred embodiment of the invention, a turret-type winder constructed according to this invention is shown generally at 10 in FIG. 1 as having a pair of substantially identical laterally spaced side frames 12 and 13 on and between which the rotary winder components are mounted. The side frames are supported on a suitable flooring and are connected or joined by beams 14 and 15.

A three station or three position winding turret is illustrated generally at 20. At each end frame, the turret has a circular support plate 22 mounted on saddle bearings 23 in the end plates , and driven by an indexing drive 25.

Individual motor drives 28 are provided for each of three winding spindles, 29, and rotate with the turret. The spindles 29 each support a core onto which the web is wound, it being understood that the core may be placed on the spindles by a suitable core loader. FIG. 1 shows a completed roll 60 that has been slit and formed in segments corresponding to the width of knives on a on-machine slitter, although the invention is not limited to a winder for slit stock only.

For the purposes of this invention, the turret 20 itself is of conventional construction, in which the end turret plates 22 are carried on the saddle bearings 23 in the openings in the end plates 12 and 13. The turret is shown as having three spindles but the turret may be designed with more or less than three if desired.

Figure 3:
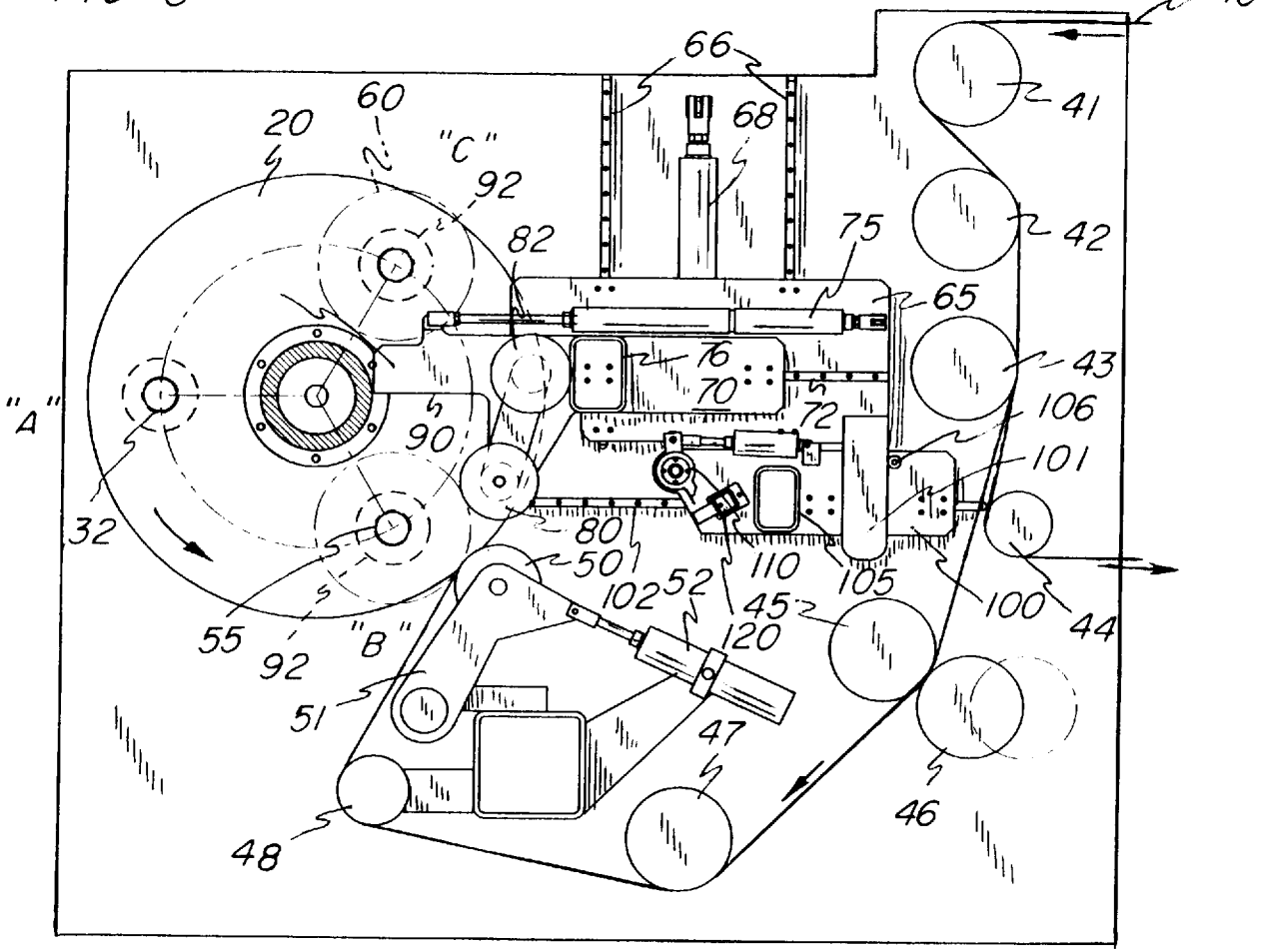
FIG. 3 is a partially diagrammatic side view showing the position of the parts of the winder after the cutting and transfer of a web onto a new core.

The description and operation of the lay-on roll assemblies and the web severing assembly are best seen and understood with reference to the partially diagrammatic views of FIGS. 3 through 6 looking at end frame 13. The structure which is illustrated in FIGS. 3–6 is, of course, repeated in reverse at the opposite end frame of the apparatus. The turret in FIG. 3 is shown in one of its three indexed positions, corresponding to the spindle locations shown. Each spindle carries a core represented by the number 32. The indexed positions, viewing FIGS. 3—6, may be referred to as the roll take off and loading station at the 9 o'clock position, the web cutting, web transfer, and initial roll building station at 5 o'clock, and the roll building completion station at the 1 o'clock position. For simplification in this description, these indexing stations may be referred to hereinafter as station "A", station "B", and station "C", respectively.

The incoming web 40 is brought over a series of guide rollers 41, 42 and 43 extending between the side frames of the winder and, if the web has been trimmed, the trimmed portion is taken off the web by a roll 44. If the machine is equipped with a slitter, it is positioned between rolls 42 and 43. The remaining web is brought between a pair of pinch rolls 45 and 46 and over bottom guide rolls 47 and 48 and over a primary lay-on roll 50. The lay-on roll 50 is mounted to the side frame on an arm 51 and is controlled by a cylinder 52. The spindle and rolls rotate counterclockwise as viewed in FIG. 3.

In FIG. 3, it will be seen that the web 40 is applied in slightly wrapped relation to the primary lay-on roll 50 to the core 32 at station "B" that will define and become a building roll 55 on the turret 20. Station "B" is the primary building station in which a major portion of the size of the roll is achieved while nipped by the lay-on roll 50. FIG. 3 also illustrates a completed roll 60 at station "C".

It is important to be able to index the building roll 55 at station "B" to the finishing station "C" while continuing an uninterrupted winding process and while applying the web with a lay-on roll. For this purpose, a secondary lay-on roll assembly includes a primary positioning carriage 65 which is mounted for generally vertical movement on the side frames on vertical rails 66. The weight of the carriage 65 is primarily carried by a cylinder 68 attached to the side frames 12 or 13.

A secondary lay-on roll carriage 70 is mounted on the primary positioning carriage 65 for generally horizontal movement, as viewed in FIGS. 3–6, on a rail 72 attached to the primary carriage. The movement of the carriage 70 is controlled by back-to-back cylinders 75. The respective carriages 70 at each end frame are joined by a cross member 76.

Figure 4:
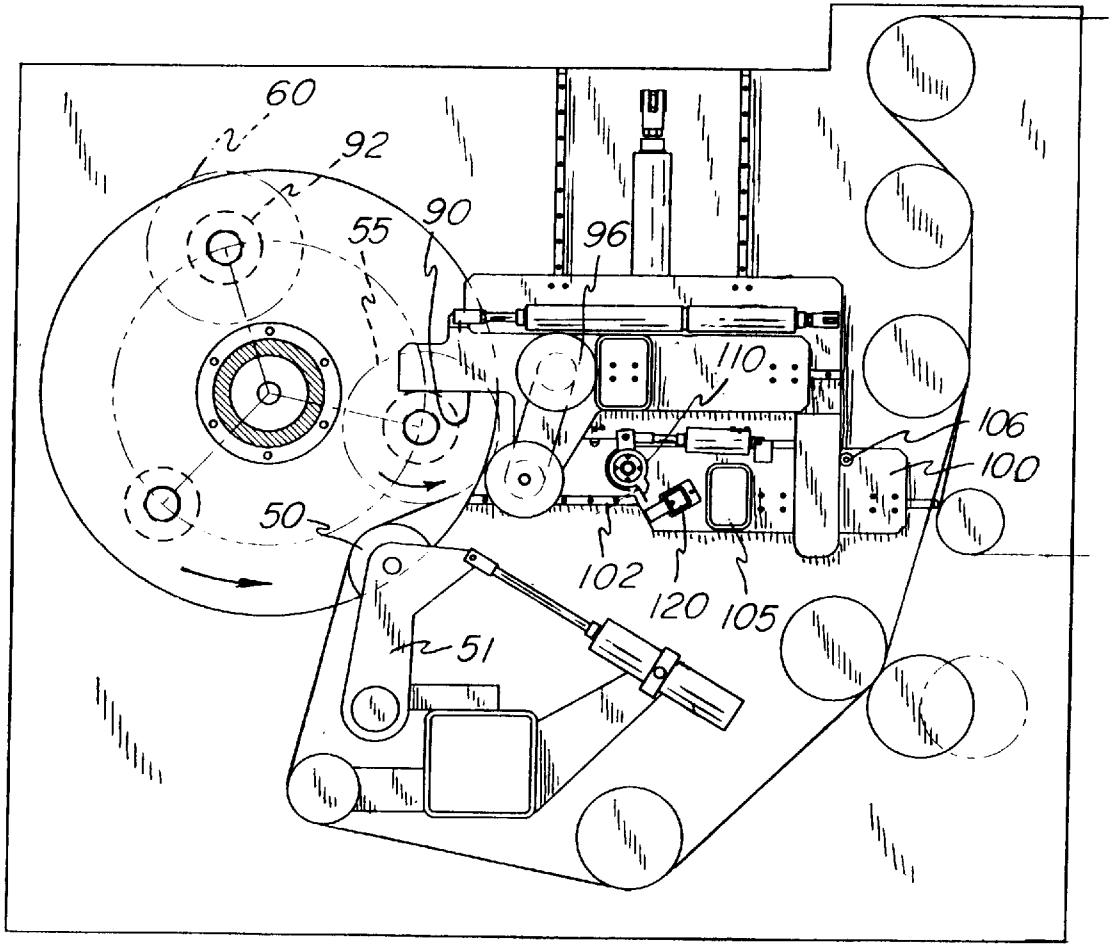
FIG. 4 is a view similar to FIG. 3 showing a partially wound roll being transferred from the cutting and building station to the roll finishing station.
Figure 6:
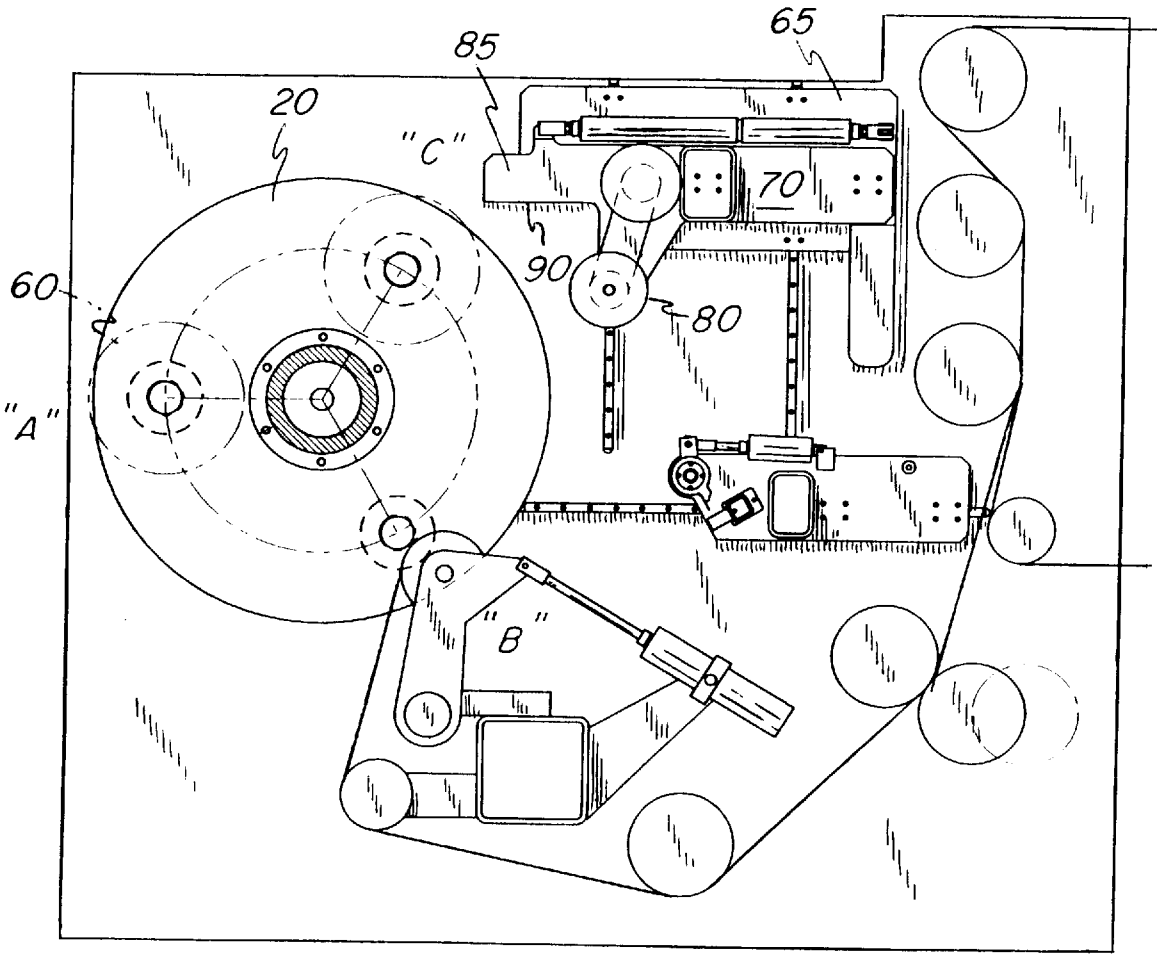
FIG. 6 is a view similar to FIG. 1 following cutting and transfer of the web to a new core and following completion of the winding of the building roll at the finishing station.

The secondary carriages 70 are moveable on the respective primary carriages 65 between a retracted position as shown in FIG. 6 and an extended operable position as shown in FIGS. 3 and 4. In the extended position, an auxiliary lay-on roll 80 is positioned by the carriage 70 to receive, in a hand-off manner, the web and the building roll 55 as the roll is indexed between positions B and C, as described in greater detail below.

The auxiliary lay-on roll 80 is fixed in position on the secondary carriage 70, and, during the initial portion of the index, is speeded up by the motor 82 and comes into contact with the periphery of the building roll 55 as it begins to be carried on the turret from station B to station C. The carriage 70 is in the "ready" or waiting position as shown in FIG. 3. The primary lay-on roll 50 will be partially retracted by reason of the size of the building roll. At the point at which the building roll 55 (FIG. 4), leaves the primary lay-on roll 50, this roll now becomes a guide roll for the web and guides the web over the auxiliary lay-on roll 80. During this movement, the secondary carriage 70 is moved to the right on the rails 72 as necessary to accommodate the arcuate movement of the building roll 55 during indexing. The cylinder 75 operates to apply the desirable nip pressure at the roll 80 with the circumference of the roll 55 while a small degree of wrap about the auxiliary lay-on roll 80 is maintained.

The secondary carriage 70 includes the feature of being provided with a means for inter-relating the position of the primary carriage 65 with respect to the axis of a winding spindle, as the spindle and roll move from position B to position C. For this purpose, the secondary carriage 70 is formed with an integral transversely-extending arm 85. The lower surface of the arm 85 is provided with a horizontally flat ledge 90. During transfer of the building roll from its initial building position shown in FIG. 3 toward the completion station "C", the spindle on which the building web is mounted moves through an intermediate position, as shown in FIG. 4. In this intermediate position, the arms 85 at the flat edge 90 move into contact with an enlarged roller bearing hub 92. The hubs 92 are located at each end of each spindle and are in coaxial alignment with the axis of the respective spindle. The hubs 92 form a temporary interconnection between the movement of the associated spindle and the carriages, 65 and 70, by which the translational or arcuate movement of the spindle is transferred directly as a lifting free to the arm 85. Also, at this position, about 90% of the weight of the carriages 65 and 70 is carried by the cylinders 68, so that the remaining 10% urges the assembly toward a lowered position.

As the partially built roll is indexed, the associated hub 92 engages the arm 85. This occurred about after 30° to 40° of rotation. The continued rotational movement of the turret causes the primary carriage, which is counter balanced by the cylinders 68, to be lifted on the rails 66 carrying with it the secondary carriage 70 and the auxiliary lay-on roll 80. This relationship is maintained throughout the completion of the building of the roll, as illustrated in FIG. 5.

Since the turret 20 is not indexed until the building roll at station B achieves a substantial size, in the range of about 70 to 90% of its full diameter, a relatively fixed geometric relationship is maintained by the concurrent movement of the carriages 65 and 70 once the arm 85 has engaged the associated spindle bearing hub 92. The auxiliary lay-on roll 80 is maintained in a position such that the web always wraps the roll 80 before contacting the building roll. The geometric relation is changed only slightly by the fact that the building roll will increase somewhat in diameter following indexing to station C. The arcuate movement of the roll 55 as well as its increase in diameter, following indexing, is accommodated by translational movement of the carriage 70 on the rail 72 and accompanied by rolling movement of the arm 85 at the surface 90 along the associated bearing hub 92. A suitable winding pressure is maintained by the cylinder 75. The weight of assembly of the carriages 65 and 70 is substantially carried by the air actuators 68 so that the major portion of the weight of the combined carriages is relieved, thereby limiting the effort required to translate the indexing movement of the turret into a lifting or elevating movement of the combined carriages 65 and 70.

Figure 5:
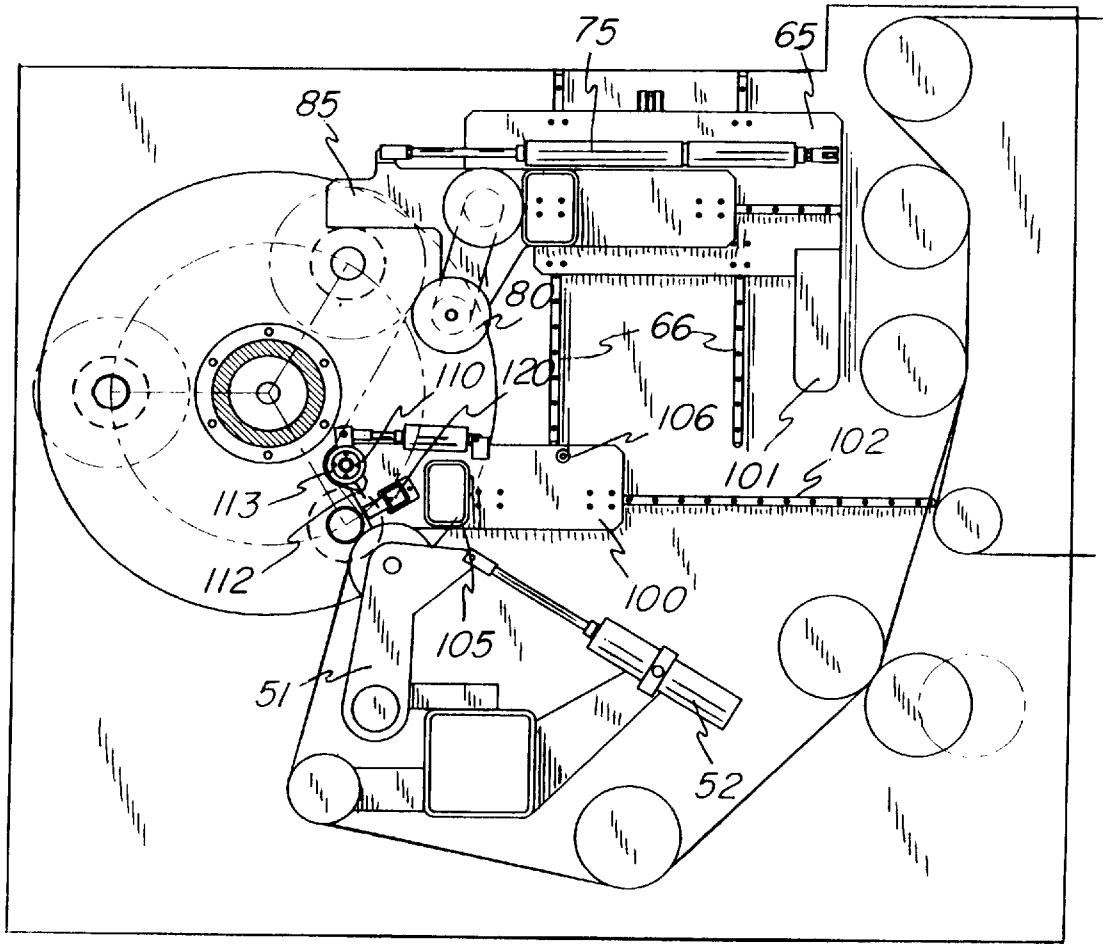
FIG. 5 is a view similar to FIG. 1 showing the roll at the finishing station and showing a completed roll at the take off and core loading station with the knife assembly in position to cut and transfer the web to a new core.

FIG. 5 illustrates the position of the parts during the cut-off and transfer of the web to a new core at station B and prior to the removal of a fully wound roll 60 at station A. Web cutting and transferring is accomplished by components mounted on a web cutting knife carriage 100 on each end frame 12, 13 moveable horizontally on guide rails 102 associated with each of the respective end frames. The carriages 100 are joined together for common movement by a cross member 105, and occupy a normal retracted position, as shown in FIGS. 3, 4 and 6. The carriages 100 are secured and retained in the retracted position, shown in FIG. 3, by a downwardly extending arm 101 mounted on the carriage 65 which, when the carriage 65 is lowered, engages a cam follower or roller 106 on the carriage 100 preventing any inadvertent movement of the carriage 100 from its stored or rest position.

During web cutting and transfer, the carriage 65 is elevated thereby releasing the arm 101 from the roller 106 and the carriage 100 is then moved to an operative position as shown in FIG. 5. The carriage 100 carries a rotary knife assembly 110. The rotary knife assembly includes a cutting knife 112 and a web drag bar 113. In the cutting and splicing position of the carriage 100, the bar 113 deflects the web in tension, and the knife is rotated clockwise about the bar 113, as viewed in FIG. 5, and is carried through the web.

The carriage 100 further carries an electrostatic charge bar 120 which is activated concurrently with the firing of the knife 112 to place an electrostatic charge on the web and core, and thereby assist in attaching the web to a core at station B in FIG. 5. The electrostatic charging bar 120 may be made and operated generally in accordance with U.S. Pat. Nos. 4,678,133 and 4,770,358, except that the charge bar is not mounted on an arm. After such cutting and transfer of the web to a new core at station B, the roll at station C is fully wound. The carriage 100 is retracted to its rest position. The carriage 70 may be elevated to the position shown in FIG. 6. In this position, the carriage 70 and the arm 85 are now fully clear of the completed roll and may be lowered to the position shown in FIGS. 3–6.

Figure 7:
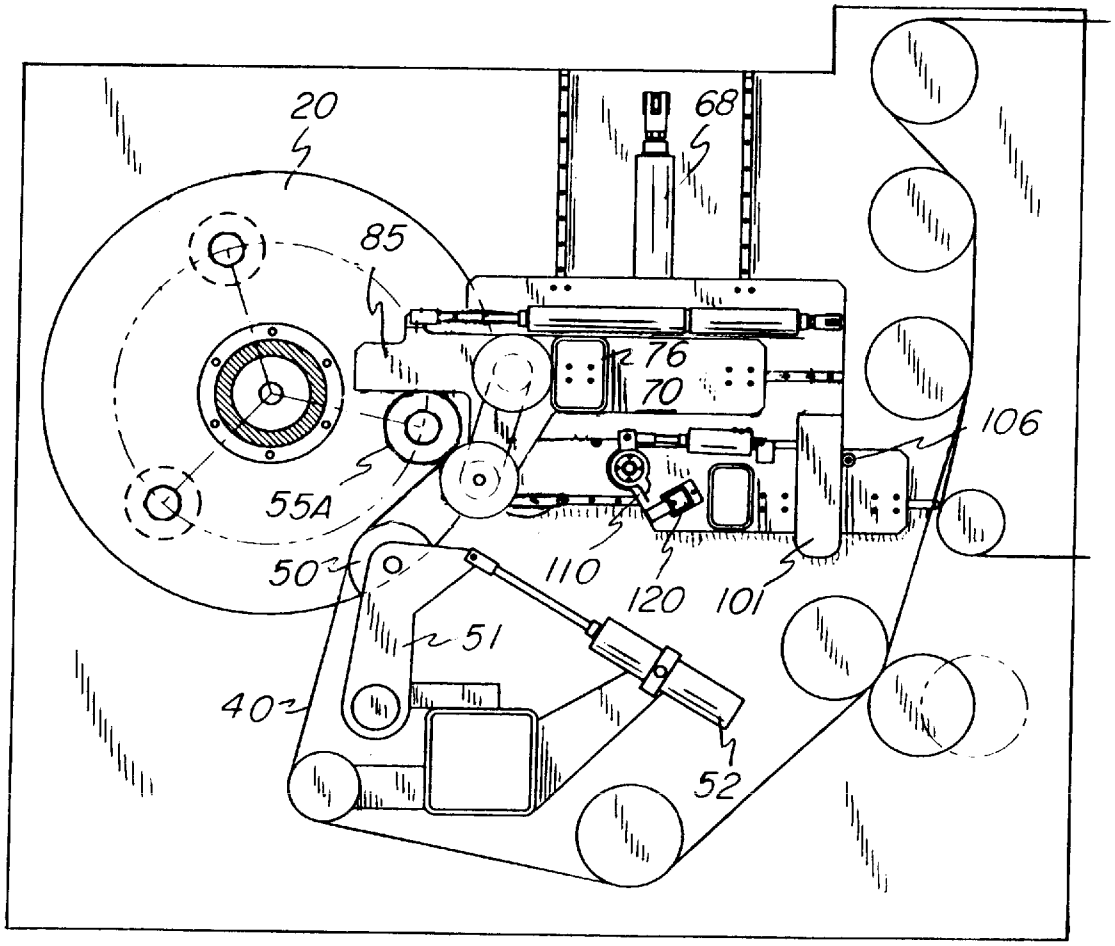
FIG. 7 is a view similar to FIG. 4 showing the conditions during transfer of a smaller building roll.

With the particular geometry of the invention as shown in FIGS. 1–6 which represent a preferred embodiment, large diameter rolls or rolls of maximum design size for the particular turret, are transferred or indexed between stations B and C and, for a very brief moment of time, the on running web as it contacts the building roll 55 will be pressed by the auxiliary lay-on roll 80 slightly inwardly of the point at which the web contacts the building roll. Air is excluded by maintaining a substantial pressure between the roll 80 and the building roll during such indexing until the roll reaches station C, at which point the web will contact the lay-on roll before it contacts the building roll. Indexing takes place quite rapidly and is accomplished in a time between about 1 to 3 seconds while using a sufficient nip pressure to eliminate air entrapment. The winder of this invention is also particularly designed for building rolls of a smaller diameter than the maximum diameter of the roll 55 as shown at station C in FIG. 5. The condition of transferring a roll between stations B and C for a smaller diameter roll is illustrated in FIG. 7, in which like parts are provided with the same reference numerals as those used in FIGS. 1–6. The only difference is that the diameter of the building roll 55*a* being indexed is smaller than that of roll 55 of FIGS. 1–6 and the geometry is such that, at no time, does the on running web come in contact with the building roll before it comes in contact with either one or the other of the lay-on rolls. In FIG. 7 it will be seen that the on running web is moving into the nip at the convergence between the lay-on roll 80 and the surface of the building roll 55*a*. Therefore with a smaller roll, the time during which the on running web is permitted to contact the surface of the building roll before being subjected to pressure by the lay-on roll is reduced or eliminated. This condition may be desirable for sticky or stretch type films that are subject to poor winding quality if any air at all becomes entrapped between the layers. The angle of web travel to the nip between the roll 80 and the building roll can be adjusted and controlled by the position of the primary roll 50 after it breaks contact with the surface of the moving building roll.

The operation of the turret winder for winding web material, according to this invention, is largely self-evident from the foregoing description. It will be understood that the core 32 is placed on the spindle at station A and moved to station B by the rotation of the turret 20 to achieve the position and condition illustrated in FIG. 3. Assuming that the web 40 has been cut and transferred by the electrostatic charge bar 113 to the core 32 at the station, building will begin by the center wind drive of the spindle motors 28 while the web is partially wrapped and nipped by the primary lay-on roll 50, as biased by the actuator 52. The roll will be allowed to continue to build to a substantial size before indexing is required, and the carriages 65 and 70 may be brought from the position shown in FIG. 6 to the position shown in FIG. 3. That is, the carriage 65 is lowered and the secondary carriage 70 is moved into its operative position shown in FIG. 3.

At a selected point in building the roll 55, the turret 20 is indexed bringing the auxiliary lay-on roll 80 into contact with the surface of the building roll. The motor 82 is used to bring the lay-on roll 80 up to speed, and further indexing pushes back both the lay-on roll, the roll 50 pivoting on the pivotal axis of the arms 51 and the roll 80 moving horizontally with the movement of the carriage 70 against the loading of the actuator 75. After about 30° to 40° of rotation, the surface of the building roll 55 lifts off the primary lay-on roll 80 and the web then runs over this roll and directly to the nip defined between the lay-on roll 80 and the building roll.

With the lay-on is under the control of the auxiliary lay-on roll 80, indexing is continued with the surface 90 of the arm 85 coming into contact with the outer race of the hub bearing 92 and all further rotational movement to position C is thus correlated with a corresponding lifting and retracting movement of the carriages 65, 70.

After arm 101 releases roller 106, the knife carriage 100 can now be moved on the rail 102 to the operation position shown in FIG. 5. When the roll building is completed, based on roll diameter, at position C, the arc knife assembly 110 may be fired to carry the knife 112 through the web and simultaneously the static bar 120 is actuated to charge the web in relation to the adjacent core 32, to affect transfer of the cut end of the web 40 onto the core surface, and the winding of the building roll is now completed. At the subsequent indexing step, the now built roll is moved to station A where it is removed, and a fresh core is loaded.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a turret winder for winding web material on spindle-supported cores, in which a turret is mounted for rotation on a frame about a generally horizontal axis carries a plurality of generally horizontally extending winding spindles movable by said turret about a circular path including means for rotating said turret in an indexing manner to bring said spindles and cores thereon successively from a web cutting and winding station, to a winding completion station, and to a roll removal and core replacement station, and in which lay-on rolls include a primary lay-on roll for engaging a newly building roll at said web cutting and winding station and an auxiliary lay-on roll engageable with a building roll moving between said web cutting and winding station to said winding completion station, the improvement comprising:

a primary carriage mounted on said frame for generally vertical movement adjacent said circular path between a lowered position and an elevated position, a lay-on roll carriage mounted on said primary carriage and supporting thereon an auxiliary lay-on roll, said lay-on roll carriage being movable between a retracted position in which said auxiliary lay-on roll is out of said circular path and an operative position in which said auxiliary lay-on roll is positioned within said circular path for engagement with the surface of a building roll, said lay-on roll carriage having a positioning arm engageable with a turret spindle moving between said cutting and winding station and said winding completion station when said primary carriage is in said lowered position and said lay-on roll carriage is in said operative position, said primary carriage being movable by said arm from its lowered position to an elevated position with indexing movement of said turret while maintaining contact of said auxiliary lay-on roll with said building roll to said winding completion station.

2. The improvement in a turret winder according to claim 1 in which said positioning arm is formed with a generally flat working surface, and in which said turret spindle is provided with a roller bearing located on the axis of said spindle and positioned to engage said arm at said flat surface during the movement of said spindle between said cutting and winding stage and said winding completion stage.

3. The improvement in a turret winder according to claim 1 further comprising a knife carriage mounted on said frame and carrying a web cutting knife thereon, said knife carriage being moveable in a straight line along said frame between a retracted inoperable position and a moved operable position in which said knife thereon may be brought into coacting relation with a web leading to a building roll for severing said web, said primary carriage having means thereon engageable with said knife carriage in said knife carriage retracted position and in said primary carriage lowered position for preventing movement of said knife carriage prior to the elevation of said primary carriage to an elevated position.

4. The improvement in a turret winder according to claim 3 in which said knife carriage also carries an electrostatic charge bar, said charge bar being positioned on said knife carriage to come into coacting relation with such web in said operative position-of said knife carriage.

5. A turret winder for winding web material on a spindle-supported core, in which a turret is mounted for rotation on a frame about a generally horizontal axis and carries three generally horizontally extending winding spindles movable with said turret about a circular path in an indexing manner to bring said spindles and cores thereon successively into three 120° spaced stations including a web cutting and winding station, a winding completion station, and a roll removal and core replacement station, comprising a primary carriage mounted on said frame for generally vertical movement between a lowered position and an elevated position, a lay-on roll carriage mounted on said primary carriage and supporting thereon a layon roll, said lay-on roll carriage being movable between a retracted position in which said lay-on roll is retracted out of said circular path and an operative position in which said lay-on roll is positioned within said circular path and engageable with the surface of a building roll moving between said web cutting and winding station and said winding completion station, said lay-on roll carriage having an arm portion proportioned to be engaged by a turret spindle moving from said web cutting and winding station to said winding completion station when said lay-on roll carriage is in said operative position, and said primary carriage being movable by said arm portion from said lowered position to said elevated position concurrently with indexing movement of a spindle carrying building roll into said winding completion station concurrently with movement of said secondary carriage toward said retracted position as necessary to maintain contact of said lay-on roll with said building roll.

6. A turret winder for winding web material on a spindle-supported core, in which a turret has generally three equally spaced horizontally extending winding spindles movable by a turret about a circular path in an indexing manner to bring said spindles and cores thereon successively from a web cut-off and winding station, to a winding completion station, and to a roll removal and core replacement station, comprising a frame, a primary carriage mounted on said frame for generally vertical movement between a lowered position and an elevated position, a lay-on roll carriage mounted on said primary carriage and supporting thereon a lay-on roll, said lay-on roll carriage being movable on said primary carriage in a generally horizontal direction between a retracted position in which said lay-on roll is retracted out of said circular path and an operative position in which said lay-on roll is positioned within said circular path for engagement with the surface of a building roll moving between said cut-off and winding station to said completion station, said lay-on roll carriage having a positioning arm engageable with the spindle moving between said cut-off station to said winding completion station when said primary carriage is in said lowered position and said lay-on roll carriage is in said operative position, said primary carriage being movable by said arm from said lowered position to an elevated position concurrently with indexing movement of said building roll from said web cut-off and winding station to said winding completion station thereby maintaining a condition in which the web contacts the lay-on roll before it contacts the building roll.

7. A turret winder for winding paper or film material on a spindle-supported core, in which a turret has three equally spaced horizontally extending winding spindles movable by a turret about a circular path in an indexing manner to bring said spindles and cores thereon successively from a web cut-off and winding station, to a winding completion station, and to a roll removal and core replacement station, comprising a primary carriage mounted on said frame for generally vertical movement between a lowered position and an elevated position, a lay-on roll carriage mounted on said primary carriage and supporting thereon a layon roll, said lay-on roll carriage being movable between a retracted position in which said lay-on roll is retracted out of said circular path and an operative position in which said lay-on roll is positioned within said circular path for engagement with the surface of a building roll, said lay-on roll carriage having a portion in engagement with a turret spindle moving from said cut-off station to said winding completion station when said primary carriage is in said lowered position and said lay-on roll carriage is in said operative position, said primary carriage being movable by said portion from said lowered position to said elevated position concurrently with indexing movement of said building roll from said web cut-off and winding station to said winding completion station.

8. The turret winder according to claim 7 further comprising a knife carriage, frame means mounting said knife carriage for movement along a generally straight line between a retracted inoperable position and a moved operable position, means on said knife carriage for cutting a web leading to the building roll at said cut-off station, an electrostatic charge bar on said knife carriage, said charge bar being moved into an operable position with respect to the web concurrently with the movement of said knife carriage into said operable position.

* * * * *

UNITED STATES PATENT AND TRADEMARK OFFICE

CERTIFICATE OF CORRECTION

PATENT NO. : 5,845,867

DATED : December 8, 1998

INVENTOR(S) : Daniel F. Hould, Thomas J. Walsh III, and Robert F. Moeller

It is certified that error appears in the above-indentified patent and that said Letters Patent is hereby corrected as shown below:

Column 9, line 16

In claim 6, line 2, delete "generally".

Signed and Sealed this

Thirtieth Day of March, 1999

*Attest:*

Q. TODD DICKINSON

*Attesting Officer*

*Acting Commissioner of Patents and Trademarks*